US012698637B2

(12) United States Patent
Müller et al.

(10) Patent No.: US 12,698,637 B2
(45) Date of Patent: Aug. 4, 2026

(54) STABILITY MONITORING FUNCTION FOR A THICK MATTER CONVEYING SYSTEM

(71) Applicant: Putzmeister Engineering GmbH, Aichtal (DE)

(72) Inventors: Ansgar Müller, Aichtal (DE); Christiane Klein, Aichtal (DE)

(73) Assignee: Putzmeister Engineering GmbH, Aichtal (DE)

( * ) Notice: Subject to any disclaimer, the term of this patent is extended or adjusted under 35 U.S.C. 154(b) by 353 days.

(21) Appl. No.: 18/552,074

(22) PCT Filed: Mar. 21, 2022

(86) PCT No.: PCT/EP2022/057307
§ 371 (c)(1),
(2) Date: Sep. 22, 2023

(87) PCT Pub. No.: WO2022/200252
PCT Pub. Date: Sep. 29, 2022

(65) Prior Publication Data

US 2024/0167292 A1 May 23, 2024

(30) Foreign Application Priority Data

Mar. 23, 2021 (DE) ..... 10 2021 107 141.0

(51) Int. Cl.
*E04G 21/04* (2006.01)

(52) U.S. Cl.
CPC ..... *E04G 21/0436* (2013.01); *E04G 21/0463* (2013.01)

(58) Field of Classification Search
CPC ..... E04G 21/0436; E04G 21/0463; F04B 7/0026
See application file for complete search history.

(56) References Cited

U.S. PATENT DOCUMENTS 5,332,366 A 7/1994 Anderson
5,344,290 A * 9/1994 Benckert ..... F04B 7/0258 417/345

(Continued)

FOREIGN PATENT DOCUMENTS

CN 201410909 Y 2/2010
CN 102434620 A 5/2012

(Continued)

OTHER PUBLICATIONS

PCT International Search Report and Written Opinion for International Application No. PCT/EP2022/057307 filed on Mar. 21, 2022; Date of Mailing: Jul. 11, 2022; 12 pgs.

(Continued)

*Primary Examiner* — Mark A Connolly
(74) *Attorney, Agent, or Firm* — Alix, Yale & Ristas, LLP

(57) ABSTRACT

The invention relates to, inter alia, a thick matter conveying system (10) comprising a thick matter pump (16) for conveying a thick matter, comprising a double-piston-type core pump (15) which has a pump frequency; an S tube (24) which can be switched by the pump frequency; and a thick matter distributing mast (18) for distributing the thick matter to be conveyed, wherein the thick matter distributing mast (18) has at least two mast arms (41); a substructure (30) on which the thick matter distributing mast (18) and the thick matter pump (16) are arranged, said substructure (30) comprising a support structure (31) for supporting the substructure (30) by means of at least one horizontally and/or vertically movable support leg (32); a sensor unit (11) for sequentially detecting at least one piece of operating information at at least one first and second point in time; and a processing unit (12) which is designed to determine a stability parameter of the thick matter conveying system (10) on the basis of the at least one piece of operating (Continued)

information detected at the first point in time, the at least one piece of operating information detected at the second point in time, and the pump frequency.

17 Claims, 4 Drawing Sheets

(56) References Cited

U.S. PATENT DOCUMENTS

| | | | | |
|---|---|---|---|---|
| 6,202,013 | B1 * | 3/2001 | Anderson | E04G 21/0436 701/50 |
| 8,827,657 | B1 | 9/2014 | Priddy | |
| 2007/0090612 | A1 | 4/2007 | Gelies | |
| 2007/0277881 | A1 * | 12/2007 | Fugel | E04G 21/04 137/351 |
| 2009/0211435 | A1 * | 8/2009 | Yi | F15B 21/12 91/361 |
| 2014/0298784 | A1 * | 10/2014 | Huang | B66C 13/066 60/327 |
| 2015/0112555 | A1 * | 4/2015 | Yi | E04G 21/0436 701/50 |
| 2015/0240812 | A1 | 8/2015 | Kemnitz | |
| 2018/0051475 | A1 | 2/2018 | Klein et al. | |
| 2021/0010281 | A1 | 1/2021 | Müller | |
| 2023/0302682 | A1 * | 9/2023 | Lehmann | F15B 11/17 |

FOREIGN PATENT DOCUMENTS

| | | | |
|---|---|---|---|
| CN | 102434620 | B | 4/2014 |
| CN | 112004977 | A | 11/2020 |
| DE | 102015208071 | A1 | 11/2016 |
| DE | 10201804079 | A1 | 9/2019 |
| DE | 102019105817 | A1 | 9/2020 |
| EP | 2799712 | A2 | 11/2014 |
| EP | 1849931 | B1 | 11/2016 |
| WO | 2005042319 | A1 | 5/2005 |

OTHER PUBLICATIONS

German Office Action for Application No. 10 2021 107 141.0 dated Dec. 23, 2021; 7 pgs.
Chinese Examination Report for Application No. 202280037111.2 filed Mar. 21, 2022, Date of publication: Jan. 20, 2026, 6 pgs.
Chinese Search Report for Application No. 2022800371112 filed Mar. 21, 2022, Dated Jan. 13, 2026, 6 pgs.
Korean Examination Report for Application No. 10-2023-7034305 filed Oct. 6, 2023, Date of dispatch: Feb. 2, 2026, 16 pgs.

* cited by examiner

STABILITY MONITORING FUNCTION FOR A THICK MATTER CONVEYING SYSTEM

BACKGROUND

The present invention relates, inter alia, to a thick matter conveying system having a thick matter pump, a thick matter distributor mast, a substructure, a sensor unit, and a processing unit, as well as to a method for operating a thick matter conveying system.

Known from the prior art are generic thick matter or slurry conveying systems. For the stability monitoring of the latter, various operating parameters are observed, so that when a critical value of such an operating parameter is exceeded, the thick matter conveying system in response thereto can be actuated in a defined manner and typically an orderly operation of the thick matter conveying system is adjusted. The operating parameters taken into account for this purpose, such as load torque, position of the overall center of gravity, cylinder force of the mast arms or leg forces of support legs, are affected by the operation of the thick matter pump of the thick matter conveying system. The operation of the thick matter pump causes periodic fluctuations in the operating parameters. However, the issue here is that when using the thick matter conveying system in peripheral situations and at the upper limit of stability owing to the influence of the operating parameters as a result of the operation of the thick matter pump, undesirable recurrent exceeding and undershooting of the upper limit and a constant switching off and switching on of the operation of the thick matter conveying system occurs.

SUMMARY

Against the background of the aforementioned issues it is therefore an object of the present invention to provide an improved thick matter conveying system and an improved method for operating a thick matter conveying system.

The achievement according to the invention lies in the features of the independent claims. Advantageous refinements are the subject matter of the dependent claims.

Disclosed according to the invention is a thick matter conveying system having a thick matter pump for conveying a thick matter, comprising a double-piston core pump which has a pump frequency, and an S-pipe which is switchable at the pump frequency; a thick matter distributor mast for distributing the thick matter to be conveyed, wherein the thick matter distributor mast has at least two mast arms; a substructure on which are disposed the thick matter distributor mast and the thick matter pump, wherein the substructure comprises a support for supporting the substructure by way of at least one horizontally and/or vertically displaceable support leg; a sensor unit for sequentially capturing at least one item of operational information at at least a first and a second point in time; and a processing unit which is specified to determine a stability parameter of the thick matter conveying system depending on the at least one item of operational information captured at the first point in time, the at least one item of operational information captured at the second point in time, and the pump frequency.

The thick matter conveying system according to the invention is, for example, a truck-mounted concrete pump.

The invention is a particularly advantageous design embodiment of a thick matter conveying system in which not only an item of operational information captured by a sensor unit is taken into account for determining the stability by way of a stability parameter, but additionally also specific operating parameters of the thick matter pump. This enables the influence on the captured item of operational information as a result of the operation of the thick matter pump to be determined. Consequently, a stability parameter of the thick matter conveying system can be determined largely independently of the operation of the thick matter pump.

The invention has recognized that it is particularly suitable to take into account the pump frequency of the core pump, which corresponds to the switching frequency of the S-pipe, for this purpose. A pumping period is to be understood to mean the duration after which a pumping process repeats itself. It corresponds to the reciprocal value of the pump frequency. Due to this definable operating parameter of the thick matter pump, which is preferably likewise captured by the sensor unit as is the item of operational information to be taken into account, the influence on the respective item of operational information as a result of the operation of the thick matter pump can be determined particularly reliably and accurately. Complex and time-consuming filtering can be dispensed with. This enables a reliable determination of stability with a particularly low temporal delay, which is thus particularly efficient. It also offers better smoothing compared to filter algorithms that do not take the pump frequency into account. It is thus made possible to avoid a shutdown of the thick matter conveying system that does not compromise stability, so that a controlled operation of the thick matter conveying system can take place in peripheral situations.

First, some terms are to be explained hereunder:

Thick matter is a generic term for hard-to-convey media. The thick matter can be, for example, a substance with coarse-grained components, a substance with aggressive components, or the like. The thick matter can also be a bulk material. In one embodiment, the thick matter is fresh concrete. Fresh concrete can contain grains up to a size of more than 30 mm, binds, forms deposits in voids, and is therefore difficult to convey. Examples of thick matter include concrete with a density of 800 $kg/m^3$ up to 2300 $kg/m^3$, or heavy concrete with a density of more than 2300 $kg/m^3$.

The thick matter pump can comprise a core pump with two, for example exactly two, conveying cylinders. In this instance, switching takes place in an alternating manner from the first to the second conveying cylinder and from the second to the first conveying cylinder. An S-pipe can be cyclically switched between the conveying cylinders. In addition, an auxiliary cylinder can be specified so as to bridge each of the transitions.

The S-pipe is a movable section of the pipe by way of which the conveying cylinders are alternately connected to the outlet of the thick matter pump. The pipe section and the auxiliary cylinder can be elements of an assembly that is releasably connected to the thick matter pump. This can facilitate maintenance and cleaning of the thick matter pump.

The thick matter distributor mast comprises at least two mast arms, but can also comprise three, four or five mast arms. Typically, the mast assembly comprises three to seven mast arms. A mast arm at its proximal end can be connected to a slewing gear of the thick matter distributor mast and at its distal end be connected to the proximal end of an adjacent mast arm. The other mast arm(s) are in succession and at their proximal end each connected to a distal end of the adjacent mast arm. The distal end of the last mast arm in succession, which moreover has no further connection at its distal end, defines a load attachment point.

The mast arms are connected to one another respectively by way of a mast joint in such a way that they can be moved at least, for example exclusively, in one dimension at least independently of the other mast arms. Each mast arm at its proximal end is assigned the mast joint.

The connection of the one mast arm to the slewing gear can be designed such that when the slewing gear rotates about an axis, this mast arm or all mast arms are also rotated about this axis. For example, the mast arm is fastened to the slewing gear in such a manner that said mast arm can be moved, for example exclusively, in a vertical direction independently of the slewing gear and, for example, can be rotated by way of its mast joint. It is also conceivable that a mast arm has a telescopic functionality and can be telescopically and continuously extended or shortened along its longitudinal axis. For example, a mast arm is adjustable so that at least the distal end of the mast arm can be moved in at least one of the three spatial directions (x, y and z directions).

Alternatively or additionally, a mast arm can be rotatable about its longitudinal axis. For example, a mast arm for its mast joint comprises at least one actuator, such as a hydraulic or pneumatic cylinder, or an electromechanical actuator, or a combination of a plurality of even different types of actuators, by way of which said mast arm can change its position relative to at least another mast arm, in particular the mast arm connected to the proximal end. The actuators can be specified, for example, to rotate the mast arm about a horizontal axis, which for example runs through its mast arm joint, and/or to move said mast arm in a translatory manner in one, in two or in all spatial directions.

Alternatively or additionally, the mast arm can have further actuators by means of which it can be extended or shortened or rotated, for example telescopically.

The substructure is a basic structure, for example a chassis, on which the thick matter distributor mast and the thick matter pump are disposed. For example, the thick matter distributor mast and/or the thick matter pump are/is fastened to the substructure. The substructure can be configured to be stationary (for example as a platform), or mobile (for example as a vehicle). As a result of the thick matter distributor mast and the thick matter pump being disposed on the substructure, the entire thick matter conveying system can be configured to be particularly compact as a unit, and for example in the form of a truck-mounted concrete pump.

The substructure comprises a support structure for supporting the substructure by way of at least one horizontally and/or vertically displaceable support leg. A support leg of a thick matter conveying system represents a component of the support structure that serves to increase the stability of the thick matter conveying system. The influence of the support structure on stability depends in particular on an individual arrangement and set-up of support legs. For this purpose, the support leg can be supported on a surface by way of a support plate. Four support legs are usually provided for a support structure.

The thick matter conveying system comprises means for carrying out or controlling the method according to the invention. These means comprise in particular the sensor unit and the processing unit, but can also comprise a control unit of the thick matter conveying system, and can respectively be configured as separate hardware and/or software components or as hardware and/or software components integrated in various combinations. The means comprise, for example, at least one memory with program instructions of a computer program, and at least one processor configured for executing program instructions from the at least one memory.

The sensor unit is specified to record at least one item of operational information, in particular automatically and independently of a user input. The capturing of the at least one item of operational information should be carried out sequentially, i.e. repeatedly at determined temporal intervals. It is conceivable that an item of operational information is captured repeatedly at specified temporal intervals. Further, it is planned that the item of operational information is captured at at least a first and a second point in time. In this way, there are at least two items of operational information of the same type, which have been captured successively by the same sensor of the sensor unit, for example.

For example, the capturing of an item of operational information can take place by measuring a measurement variable which is characteristic of this item of operational information. To this end, the sensor unit can include one or a plurality of sensors of the same type or of different types. Exemplary sensors include force and pressure sensors (e.g. for capturing a cylinder force of a mast joint, a force acting on an actuator of a mast arm or a leg force of a support leg), position sensors (e.g. sensors of a satellite-based position system such as GPS, GLONASS or Galileo), position sensors (e.g. spirit levels or inclination sensors for capturing an inclination angle of a mast arm), electrical (e.g. induction sensors), optical (e.g. light barriers, laser sensors or 2D scanners) or acoustic sensors (e.g. ultrasonic sensors) as vibration sensors for capturing the pump frequency. Likewise, an item of operational information can also be captured by the interaction of a plurality of sensors of the sensor unit. For example, the item of operational information to be captured can be ascertained in a particularly precise manner by combining the measurements of a vibration sensor and of a pressure sensor.

Alternatively or additionally, the sensor unit can also comprise one or a plurality of (e.g. wireless) communication means by way of which items of operational information captured (e.g. externally) and provided by a user by way of a user input at a user terminal, for example, can be received at the sensor unit in a manner known by a person skilled in the art.

The processing unit is to be understood as being specified to determine a stability parameter of the thick matter conveying system. This is to take place so as to depend on the at least one, in particular all, item(s) of operational information captured at the first point in time, the at least one, in particular all, item(s) of operational information captured at the second point in time, and the pump frequency. To this end, said processing unit can have access to the items of information captured by the sensor unit, for example. Determining the stability parameter is also to be understood as comprising that the stability parameter is calculated by reference to defined properties of components of the thick matter conveying system that are assumed to be constant, such as their mass or their spatial extent, for example. To this end, the processing unit can also take into account the development of the pump frequency over time.

The stability of the thick matter conveying system is increased the greater the spacing of the line of action, which takes into account all the forces acting on the thick matter conveying system, from the tilting edges of the contact surface. However, a reliable statement pertaining to the stability can already be made on the basis of a line of action that at least takes into account the weight force acting on the thick matter conveying system. The more of the forces actually acting in the line of action are taken into account, the more precise this statement can be made. Therefore, the stability of the thick matter conveying system can be characterized particularly advantageously by a stability parameter representing the spacing of the line of action from the tilting edges of the contact surface. The stability parameter is located within a defined or dynamically determinable stability range, within which the spacing of the line of action from each of the tilting edges is greater than or equal to zero, a safety margin preferably also being taken into account here. The stability of the thick matter conveying system is provided within the stability range. The upper limit of the stability range is defined by a maximum stability parameter. The maximum stability parameter is present when the spacing of the line of action from one of the tilting edges is zero. Accordingly, the spacing of the line of action from at least one of the tilting edges decreases as the stability parameter increases. Above the upper limit, the spacing is less than zero and the stability of the thick matter conveying system is no longer provided. It is conceivable that a stability range for each operating situation of the thick matter conveying system is defined or determinable, for example taking into account properties of the components to be taken into account of the thick matter conveying system that are assumed to be constant. For example, for each possible arrangement of the support structure, for example by a determined set-up of support legs, a contact surface can be defined or determinable for this purpose.

The spacing of the line of action from one of the tilting edges and the orientation of the line of action are in each case at least dependent on the weight force of the thick matter conveying system and can be calculated by the processing unit, for example. The orientation of the line of action can have vertical and horizontal direction components, and can depend on directions of action and/or values of multiple forces. For example, one or a plurality of forces to be taken into account can be defined or can be selectable by a user (e.g. by means of a suitable user interface). If, for example, only the weight force of a thick matter conveying system is taken into account, then the line of action corresponds to a plumb line running through the overall center of gravity. The orientation of the line of action in this instance is identical to the position of the plumb line. If the orientation of the line of action additionally depends on a force having a horizontal component, such as a wind force acting on the side of the thick matter conveying system, then the orientation of the line of action also includes at least one horizontal component, and its position is not equal to the plumb line. It is conceivable that the orientation of the line of action is dependent on one or a plurality of additional forces in such a way that the processing unit can adapt the position gradually, preferably only, upon the occurrence of one or a plurality of specific conditions, for example above a wind force prevalent in the operation of the thick matter conveying system, for example in each case by a defined amount in a defined direction. It is also conceivable that the orientation of the line of action depends on the directions of action and/or values of one or a plurality of, preferably all, items of operational information that are indicative of forces captured by the sensor unit.

An item of operational information is indicative of a property or an operating parameter of a multiplicity of possible properties and operating parameters of the thick matter conveying system or individual components of the thick matter conveying system, and representative of that property or that operating parameter. It should thus be possible to assign an item of operational information to a component. Such a property or such an operating parameter can be characterized, for example, by a measured variable. These can be properties and operating parameters that come to light as early as before or only after the start of the conveying process.

Preferably, the sensor unit has one or a plurality of sensors for capturing the pump frequency, wherein the processing unit is specified to determine the stability parameter of the thick matter conveying system depending on the captured operational information and the captured pump frequency.

For example, the sensor unit can have one or a plurality of optical vibration sensors for capturing the pump frequency. In this way, the processing unit can take into account current values of the pump frequency. A prediction of the pump frequency, which is potentially prone to errors, can thus be dispensed with. As a result, even small variances from a setpoint of the pump frequency can be included in the determination of the stability parameter, which significantly increases the accuracy of the determination.

In another embodiment, the temporal interval between the first and the second point in time is dependent on the pump frequency. For example, the spacing at a high pump frequency can be smaller than at a lower pump frequency. Preferably, the second point in time is delayed by the duration of half a pumping period compared to the first point in time.

In this way, the effects of the operation of the thick matter pump on the captured item of operational information can be particularly advantageously reduced based on the items of operational information captured at the first and the second point in time, while taking into account the pump frequency, for example by means of mean value formation and/or convolution.

Optionally, the item of operational information captured at the first point in time is the most recent captured item of operational information.

This permits the stability to be determined based on ideally up-to-date items of operational information. The risk that the determined stability parameter might not be accurate at all in the current situation due to the use of older information can thus be minimized.

In one embodiment, the processing unit is specified to determine the stability parameter depending on a result of mean value formation, wherein the mean value formation takes place depending on the captured items of operational information.

This represents a particularly simple method to be able to ascertain the influence on the captured item of operational information as a result of the operation of the thick matter pump, and thus to determine the stability parameter with little complexity, without having to resort to computationally intensive procedures, such as the use of filter algorithms.

By way of example, the processing unit is specified to determine the stability parameter depending on items of operational information captured at a plurality of first and at a plurality of second points in time, each of the plurality of second points in time being delayed respectively by the duration of half a pumping period in comparison to a corresponding point in time of the plurality of first points in time.

Accordingly, the points in time at which two corresponding items of operational information are captured are in each case separated by the duration of half a pumping period. The items of operational information captured at a plurality of first points in time can be a most recent captured item of operational information, and can be items of operational information sequentially captured by the same sensor at two points in time immediately prior to the most recent capturing. The items of operational information captured at a plurality of second points in time in this instance can be the items of operational information captured by the same sensor at half a pumping period prior to the most recent captured item of operational information, and can be two items of operational information which have respectively been captured sequentially, likewise by the same sensor, at half a pumping period prior to the two sequentially captured items of operational information.

In this example, a total of six items of operational information captured by the same sensor are thus included in the determination of the stability parameter. Of these, a first item of operational information is the most recent captured item of operational information, a second and a third item of operational information are in each case sequentially captured at different points in time in the past, a fourth item of operational information is captured at half a pumping period prior to the most recent captured item of operational information, a fifth is captured at half a pumping period prior to the second item of operational information, and a sixth is captured at half a pumping period prior to the third item of operational information. Consequently, this results in six items of operational information, each captured in pairs separated by half a pumping period. Accordingly, in this example, the first and the fourth, the second and the fifth, as well as the third and the sixth item of operational information should all respectively be understood to correspond to one another.

Such a design embodiment of the processing unit enables a particularly simple and fast determination of the stability parameter and thus offers a shorter time delay compared to a time-consuming determination by filtering using complex filter algorithms. As a result, tolerance ranges which during operation in peripheral situations have to be fundamentally included in the calculation and conservatively sized, as is usual in the industry, can be kept small.

Advantageously, the processing unit is specified to store at least temporarily a plurality of items of operational information captured at points in time prior to the first point in time.

In this way, the processing unit can have a corresponding memory which is configured to store a plurality of items of operational information and is of a sufficient size, for example. If the processing unit can access historical items of operational information, it is possible to use extensive statistical tools to determine the stability parameter, which further increases the precision of the determination.

Additionally, the processing unit can be specified to store captured items of operational information that have been captured at a point in time which is at most one pumping period behind the first point in time.

This permits the requirements in terms of storage size and storage duration to be kept low, so that cost-effective storage solutions of a small size and little complexity can be utilized.

Preferably, the sensor unit is specified to record the items of operational information to be captured sequentially by the same sensor at at least a first and a second point in time.

It is indeed conceivable that the items of operational information to be captured are captured by different sensors of the same type, for example in order to be able to notice capturings of a sensor which are erroneous for technical reasons. However, only when the same sensor is used can the highest possible signal fidelity and correspondingly high accuracy be achieved when determining the stability parameter.

In one embodiment of the thick matter conveying system, the sensor unit is specified to sequentially record an item of operational information which is indicative of a joint torque of a mast arm of the thick matter conveying system, an inclination angle of at least one mast arm, an actuator force of at least one actuator of a mast arm, an operating speed of at least one actuator of a mast arm, a load weight at a load attachment point of the thick matter conveying system, a rotating speed of a slewing gear, an inclination angle of the thick matter conveying system and/or a horizontal or a vertical leg force of at least one support leg of the thick matter conveying system.

The joint torque of a mast arm is the moment acting on its mast joint. This represents a moment that depends, inter alia, on the total weight of the mast assembly, on wind loads, on the weight of a thick matter currently conveyed, or also on a weight acting at the distal end of the first mast arm of the mast assembly, corresponding to a mast peak load. A conclusion pertaining to the joint torque can be drawn, for example, by measuring a cylinder force acting in the actuator of the mast arm or a cylinder pressure acting in the actuator of the mast arm in conjunction with one or a plurality of other measurements, such as a measurement of the respective joint angle. For example, the joint torque of a mast arm can be calculated by means of a transmission function from a cylinder force and a joint angle of the mast joint of the respective mast arm. The inclination angle of a mast arm can be an absolute inclination angle, i.e. an angle that determines the position of the mast arm relative to the plumb direction, or a relative inclination angle, that is, a differential angle between inclination angles of two, in particular adjacent, mast arms. In the latter case, the differential angle then corresponds to the opening angle of the distal mast arm. The load weight in this instance corresponds to the weight force acting at the load attachment point. The inclination angle of the thick matter conveying system is to be an angle of the thick matter conveying system, for example of its substructure, in relation to the plumb direction. For example, the inclination angle of the thick matter conveying system corresponds to an angle between the rotation axis of the slewing gear and the plumb direction. A horizontal or vertical leg force is to be understood to mean a horizontal or vertical force acting on a support leg.

Further exemplary items of operational information are indicative of the weights of all mast arms with filled and/or unfilled conveyor line, of positions of the centers of gravity of all mast arms, of weights of additional loads, of positions of additional weight attachment points, of wind forces acting on the mast arms, of positions of the wind centers of gravity of all mast arms, of a weight of the substructure, of a position of the center of gravity of the substructure, and of positions of the installation surfaces of the support legs in the retracted and/or extended state.

The stability parameters of the thick matter conveying system can be reliably determined by way of these properties. This, in turn, makes it possible to make a reliable statement pertaining to the stability of the thick matter conveying system.

For example, the processing unit can be specified to calculate a load torque based on captured items of operational information indicative of the joint torques of all mast arms, and to determine the stability parameter depending on the calculated load torque.

In this way, the processing unit can, for example, perform a precise determination of the stability parameter in real time, taking into account the cylinder pressure and the inclination angle of the respective mast arms. Accordingly, the sensor unit in this instance must be specified to record items of operational information indicative of the cylinder force and the inclination angles of all mast arms, and for example include a plurality of suitable sensors for this purpose.

According to one embodiment, the processing unit is specified to calculate a current position of the overall center of gravity of the thick matter conveying system from a plurality of captured items of operational information, in particular of different types, and to determine the stability parameter depending on the calculated current position of the overall center of gravity. For example, the processing unit can be specified to calculate the respective distance of a line of action of at least one force acting on the thick matter conveying system from the tilting edges of the contact surface, and to determine the stability parameter depending on the calculated distance, wherein the at least one force acting on the thick matter conveying system comprises a weight force of the thick matter conveying system acting on the current position of the overall center of gravity of the thick matter conveying system.

By way of example, the sensor unit in this instance is specified to record an item of operational information indicative of a position of the slewing gear, an item of operational information indicative of a position of at least one of the mast arms, an item of operational information indicative of a position of the support leg, an item of operational information indicative of an inclination angle of the thick matter conveying system, and an item of operational information indicative of an extension of the thick matter conveying system. The processing unit indeed requires access to a multiplicity of properties of the thick matter conveying system, such as the mass and center of gravity of one, of a plurality of, or of all components, for example. Nevertheless, a particularly reliable determination of the stability parameter can take place in this way.

Preferably, the thick matter conveying system comprises a control unit for emitting a first control signal if the determined stability parameter of the thick matter conveying system is greater than a maximum stability parameter of the thick matter conveying system, and for emitting a second control signal if the determined stability parameter of the thick matter conveying system is less than or equal to the maximum stability parameter of the thick matter conveying system. Alternatively or additionally, emitting further control signals can be provided by the control unit, for example if a predetermined minimum distance between the determined stability parameter and the maximum stability parameter is not reached.

The control unit includes corresponding means to emit control signals, such as a wired or wireless signal output. As a result of the output of control signals in the manner described, the control unit can control at least one component of the thick matter conveying system, and act on an operating parameter of the component. It is conceivable that while emitting the second control signal causes a continuation of the orderly operation, emitting the first control signal causes a discontinuation of the orderly operation of the thick matter conveying system. Emitting the further control signals can, for example, cause the operation of one or a plurality of components of the thick matter conveying system to take place at a reduced speed in comparison to the orderly operation.

For example, the control unit can be specified to limit an operating range of the thick matter distributor mast to a currently permissible operating range if the determined stability parameter of the thick matter conveying system is greater than the maximum stability parameter, to which end the control unit comprises corresponding means.

Limiting an operating range of one or a plurality of components of the thick matter conveying system is to be understood as limiting an operating parameter of the respective component and causing the component to operate according to the limited operating parameter. This means that the respective operating parameter can be limited to a still permissible scope of action, or a still permissible intensity of action, of the component, depending on the determined stability parameter. The operation of the component outside the permissible operating range is prevented in particular. Upon limiting, the scope of action or intensity of action is smaller than the maximum scope of action provided respectively for the component in principle, for example during the orderly operation, and the maximum action intensity fundamentally provided. For example, the control unit for the operating range of the thick matter distribution mast can determine a currently permissible upper limit and the operation of the thick matter conveying system can be effected in such a way that the thick matter distribution mast is deflected only below the specified upper limit. Accordingly, it can then be prevented, for example, that the opening angle or the actuator force of a mast arm of the thick matter distribution mast exceeds a correspondingly determined limit. To this end, the respective actuator can, for example, receive a suitable control signal, which is emitted by the control unit. For example, the control unit can thus limit the deflection of a mast arm by an actuator. Moreover, limiting the operating range of the thick matter distribution mast is also to be understood as additionally or alternatively limiting the rotation angle range of a slewing gear of the thick matter distribution mast.

Moreover disclosed according to the invention is a method for operating a thick matter conveying system having a thick matter pump for conveying a thick matter, comprising a double-piston core pump which has a pump frequency, and an S-pipe which is switchable at the pump frequency; a thick matter distributor mast for distributing the thick matter to be conveyed, wherein the thick matter distributor mast has at least two mast arms; a substructure on which are disposed the thick matter distributor mast and the thick matter pump, wherein the substructure comprises a support structure for supporting the substructure by way at least one horizontally and/or vertically displaceable support leg; and having a sensor unit (11) for sequentially capturing at least one item of operational information; and having a processing unit (12), the method comprising the steps: sequentially capturing, by the sensor unit, at least one item of operational information at least a first and a second point in time; and determining, by the processing unit, a stability parameter of the thick matter conveying system depending on the at least one item of operational information captured at the first point in time, the at least one item of operational information captured at the second point in time, and the pump frequency.

In one embodiment, the method further comprises the steps: emitting, by a control unit of the thick matter handling system, a first control signal if the determined stability parameter of the thick matter handling system is greater than a maximum stability parameter of the thick matter handling system; and emitting, by the control unit, a second control signal if the determined stability parameter of the thick matter handling system is less than or equal to the maximum stability parameter of the thick matter handling system.

Additionally, the emitting of the first control signal can comprise: limiting the operating range of the thick matter distribution mast to a currently permissible operating range.

For the further explanation of further advantageous refinements of the methods, reference is made to the above-described refinements of the thick matter conveying system.

The invention also comprises a computer program with program instructions to cause a processor to carry out and/or control the method according to the invention when the computer program is executed on the processor. The computer program according to the invention is stored, for example, on a computer-readable data carrier.

The embodiments and design embodiments described above are to be understood as only exemplary and are not intended to limit the present invention in any way.

BRIEF DESCRIPTION OF THE DRAWINGS

The invention will be explained in more detail in an exemplary manner hereunder with reference to the appended drawings and by way of advantageous embodiments.

DETAILED DESCRIPTION

Figure 1:
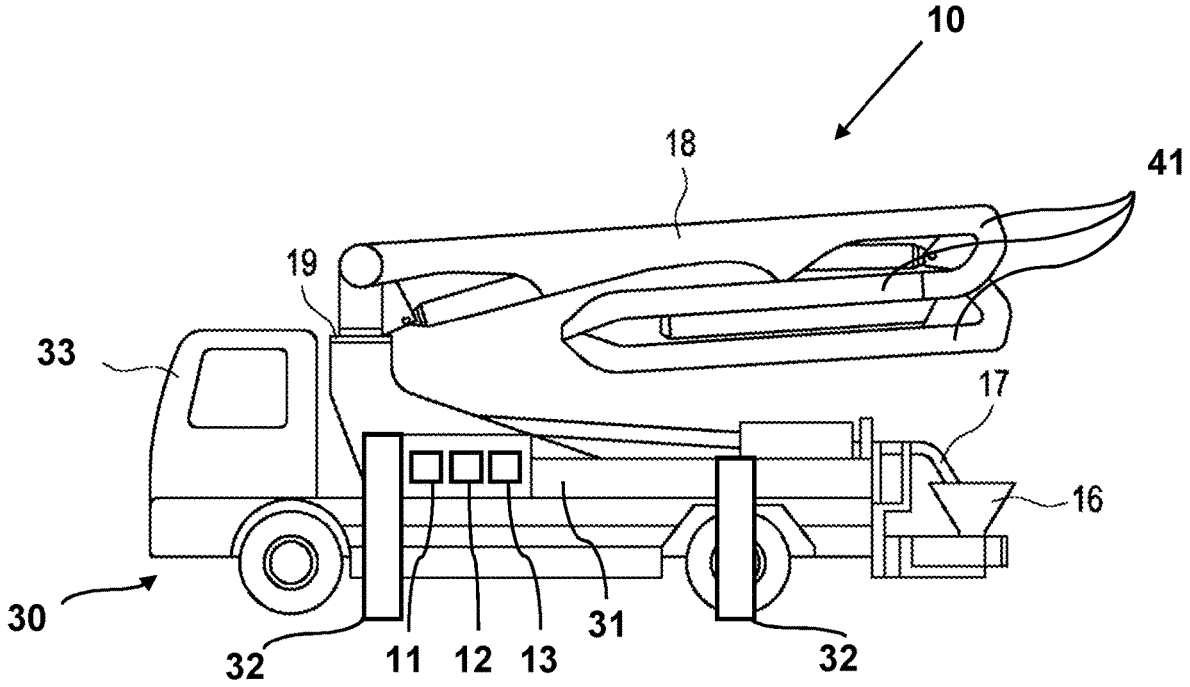
FIG. 1 shows a schematic illustration of an exemplary embodiment of a thick matter conveying system according to the invention.

Shown in FIG. 1 is a thick matter conveying system 10 which comprises a thick matter pump 16 for conveying a thick matter and a thick matter distributor mast 18 for distributing the thick matter to be conveyed, wherein the thick matter distributor mast 18 has a slewing gear 19, which is rotatable about a vertical axis, and a plurality of mast arms 41. Further illustrated is also a conveying line 17 which extends across the mast arms 41 and is connected to the thick matter pump 16.

Moreover, the thick matter conveying system 10 comprises a substructure 30 on which are disposed the thick matter distributor mast 18 and the thick matter pump 16. The substructure 30 has a support structure 31 having four support legs 32 for supporting the substructure 30. The substructure 30 by way of example is shown as disposed on a vehicle 33.

Further provided are a sensor unit 11 and a processing unit 12. The sensor unit 11 is specified to sequentially record at least one item of operational information at at least a first and a second point in time. For example, it can to this end access operational information repeatedly captured respectively by one or a plurality of sensors by way of wired or wireless signal lines.

Optionally, the sensor unit 11 can also be configured for capturing the pump frequency of the core pump 15 or of the S-pipe 24 and, for example, have one or a plurality of suitable vibration sensors.

The processing unit 12 is specified to determine a stability parameter of the thick matter conveying system 10 depending on the item of operational information captured at the first point in time, the item of operational information captured at the second point in time, and the pump frequency. The stability parameter characterizes the current stability of the support structure 31 and thus of the thick matter conveying system 10. Accordingly, the processing unit 12 has access to the item of operational information sequentially captured at at least a first and a second point in time as well as to the pump frequency of the core pump 15. Provided to this end for the thick matter conveying system 10 is a corresponding design embodiment of the sensor unit 11 and of the processing unit 12 with the necessary hardware and/or software components. In this way, the processing unit 12 can, for example, access data stored in a memory, the item of information pertaining to the respective mass and/or to the respective spatial extent of all components of the thick matter conveying system 10, and in particular to the pump frequency, as required. The operating parameter pump frequency can be defined or else likewise captured by the sensor unit 11 and then be rendered accessible to the processing unit 12 and stored, for example, in a corresponding memory.

Figure 2:
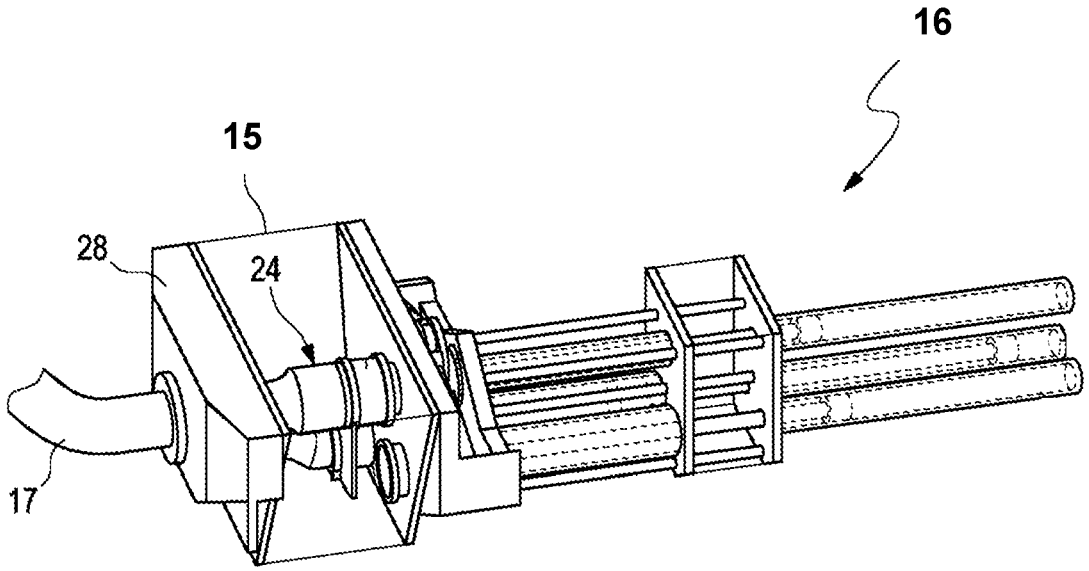
FIG. 2 shows a schematic illustration of a thick matter pump of a thick matter conveying system according to the invention.

FIG. 2 shows a thick matter pump 16 for conveying a thick matter. The thick matter pump 16 comprises a double-piston core pump 15 and a switchable S-pipe 24. The core pump 15 here has a pump frequency which corresponds to a switching frequency of the S-pipe 24, by way of which the one end of the S-pipe 24 is switched back and forth between the two pistons of the core pump. At an output 28 of the thick matter pump 16, the other end of the S-pipe 24 is connected to the conveying line 17 of the thick matter distributor mast.

Figure 3:
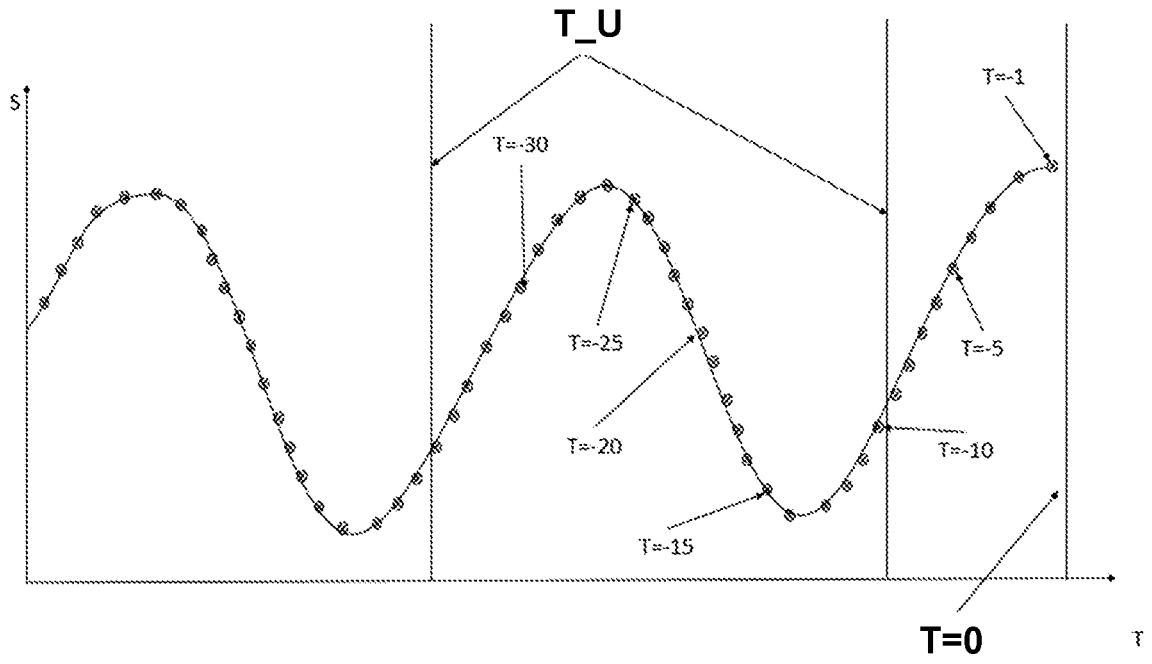
FIG. 3 shows a diagram depicting the effects of the operation of a thick matter pump on an item of operational information to be captured.

A processing unit 12 of an exemplary design embodiment is to be described in more detail by way of FIG. 3 which represents a diagram which illustrates the effects of the operation of a thick matter pump 16 on an item of operational information to be captured. Here, the values of the observed operational information 8 have a component oscillating at the pump frequency of the core pump 15. An item of operational information indicative of the cylinder force of the mast arm 41 connected to the slewing gear 19 can be used as an example of such an item of operational information 8. In the diagram of FIG. 3, captured values of the item of operational information S are plotted over time T. The time T=0 represents the present, and T=−x represents the $x^{th}$ time in the past at which the operational information S was captured, whereby the operational information captured at the time T=−1 represents the most recent captured operational information. Accordingly, the processing unit 12 is specified to store at least the operational information captured at 26 historical points in time. A pumping period comprises in the present case a period from T=−x to T=x−25, so the pump frequency is the reciprocal value over this period. T_U marks the times of the changeovers of S-pipe 24 and thus also provides information pertaining to the pump frequency.

The processing unit 12 is specified to determine the stability parameter depending on the item of operational information captured at the first point in time, and the operational information captured at the second point in time. The second point in time is delayed by the duration of half a pumping period compared to the first point in time. A mean value is formed from the most recent item of operational information S(T=−1) captured at the time T=−1 and the item of operational information S(T=−14) captured half a pumping period prior thereto, i.e. at the time T=−14. The result represents an item of operational information modified by smoothing S_mod(T=−1), which has been relieved of the effect of the operation of the pump on the captured item of operational information.

Moreover, the processing unit 12 can be specified to determine the stability parameter depending on items of operational information captured at a plurality of first and at a plurality of second points in time, each of the plurality of second points in time being delayed by the duration of half a pumping period compared a corresponding point in time of the plurality of first points in time.

In the process, further or even all of the items of operational information captured by a sensor of the sensor unit 11 and accessible to the processing unit 12 can be viewed. In addition to the modified item of operational information S_mod(T=−1) described above, further modified items of operational information S_mod(T=−x) can be calculated. These further modified items of operational information can then represent the mean value from an item of operational information captured at a first point in time T=−x and an item of operational information captured a second point in time T=−x−13 and thus half a pumping period prior thereto. In order to further improve the accuracy, a mean value of S_falt can then also be formed from all modified items of operational information, which then in turn corresponds to a deconvolution of the most recent captured first item of operational information:

$$S_{falt}(T=-1)=$$

$$\text{Mean Value}\left(\frac{S(T=-1)+S(T=-14)}{2},\left(\frac{S(T=-2)+S(T=-15)}{2}\right),\ \ldots\right)$$

It is also conceivable that the items of operational information captured at earlier points in time will be given less weight. Thus, the weighting of the modified items of operational information S_mod(T=−x) can decrease gradually or continuously as x increases.

The modified items of operational information or mean values, respectively, in turn dependent on the pump frequency, can then be utilized to determine the stability parameter. For example, a current position of the overall center of gravity of the thick matter conveying system 10 can be calculated to this end from a plurality of suitable modified items of operational information of different types while taking into account the masses and the spatial extents of relevant components of the thick matter system, such as the mast arms, for example. The smaller the spacing of the line of action from the tilting edges of the contact surface, which takes into account at least the weight force of the thick matter conveying system acting at the overall center of gravity, the lower the stability, and the higher the stability parameter is determined.

Moreover in the present example, an optional control unit 13 of the thick matter conveying system 10 is additionally configured to actuate one or a plurality of components of the thick matter conveying system 10 by way of control signals, depending on the stability parameter determined by the processing unit 12. Accordingly, the control unit 13 is specified for emitting a first control signal if the stability parameter determined by the processing unit 12 is greater than a maximum stability parameter of the thick matter conveying system 10. In this case, the control unit 13 then limits an operating range of the thick matter distributor mast 18 to a currently permissible operating range. Further, the control unit 13 is additionally specified to emit a second control signal if the determined stability parameter is less than or equal to the maximum stability parameter.

Figure 4:
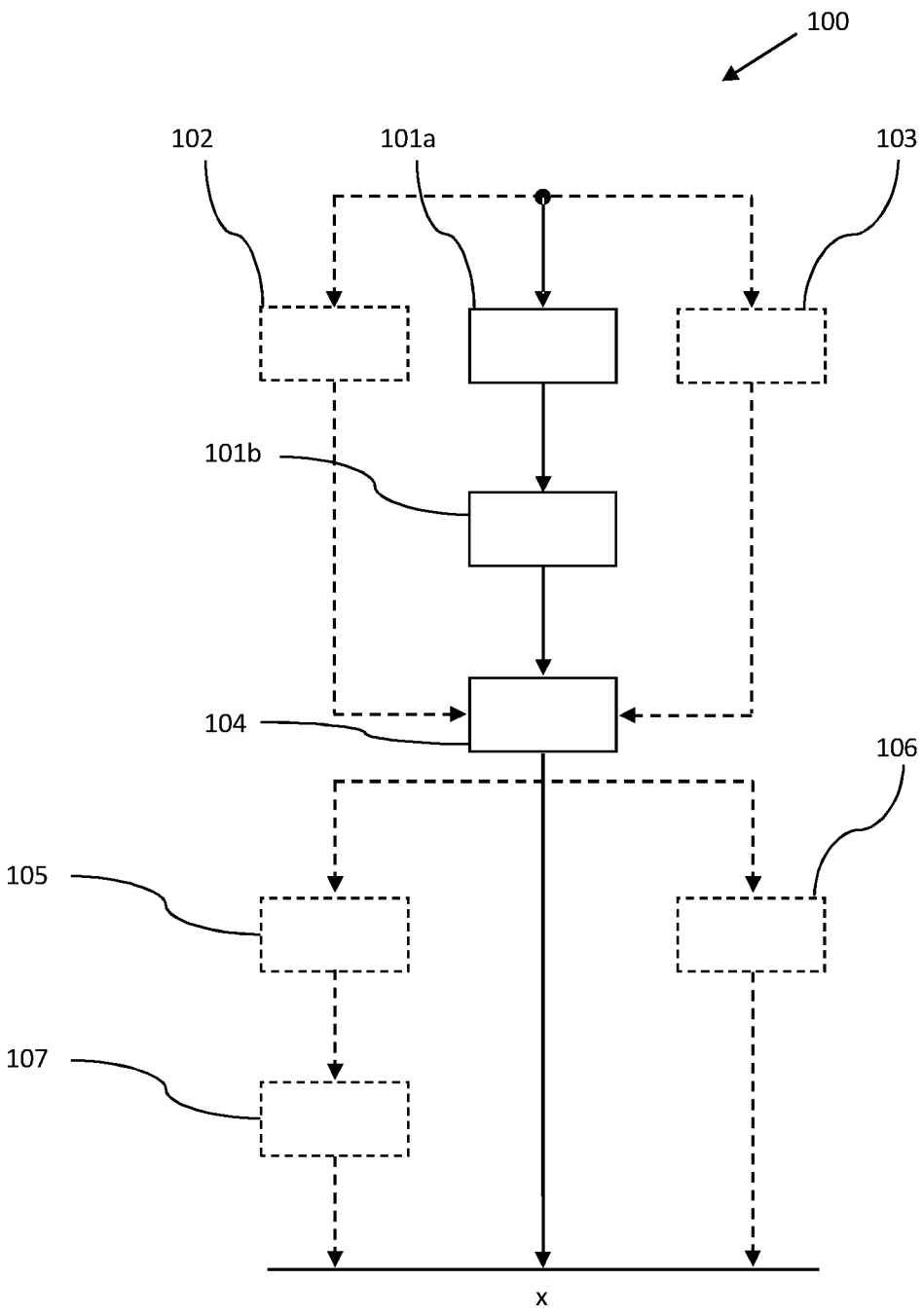
FIG. 4 shows a schematic flow chart of an embodiment of a method according to the invention.

FIG. 4 shows a flow chart of an exemplary embodiment of a method 100 according to the invention.

In a step 101*a*, the sensor unit 11 records an item of operational information of the thick matter conveying system 10. In a sequentially following step 101*b*, the sensor unit 11 then records the item of operational information again. According to the convention applied here, the point in time of capturing in step 101*a* is the second point in time, and the point in time of capturing in step 101*b* is the first point in time. By way of example, step 101*a* lags here by half a duration of a pumping period compared to step 101*b*. The item of operational information captured in step 101*b* is to be the most recent captured item of operational information. In steps 102 and 103, the pump frequency can likewise have been captured by the sensor unit 11.

Depending on the items of operational information captured sequentially by the sensor unit 11 in steps 101*b* and 101*a* at the first and the second point in time, and depending on the pump frequency, a stability parameter of the thick matter conveying system 10 is determined in step 104 by the processing unit 12. As already explained in the context of FIG. 3, a mean value is to be formed here from the item of operational information captured in step 101*b* and the item of operational information captured in step 101*a*. Obtained as a result is a modified item of operational information which has been relieved of the effect of the operation of the pump on the captured item of operational information. On this basis, the processing unit 12 then determines a stability parameter, for example, by calculating a current position of the overall center of gravity of the thick matter conveying system 10, while taking into account the mass and the spatial extent of all mast arms 41.

Optionally here, this is followed by one of steps 105 and 106.

If the stability parameter of the thick matter conveying system 10 determined by the processing unit 12 is greater than a maximum stability parameter of the thick matter conveying system 10, a control unit of the thick matter conveying system 10 emits a first control signal in step 105. By means of such a control signal, the control unit actuates at least one component of the thick matter conveying system 10 and thus acts on an operating parameter of the component. This can include, for example, a further step 107 in the form of limiting the operating range of the thick matter distributor mast 18 to a currently permissible operating range.

In the opposite case, that is, in a determination of the stability parameter of the thick matter conveying system 10 by the processing unit 12 being less than or equal to the maximum stability parameter of the thick matter conveying system 10, the control unit can emit a second control signal in a step 106. For example, the control unit can in this way drive a thick matter pump 16 so that the pump frequency is increased or reduced.

The embodiments of the present invention described in this specification and the optional features and properties listed respectively in this regard are also to be understood as being disclosed in all combinations with one another. In particular, the description of a feature comprised by an embodiment is also presently not to be understood in such a way that the feature is crucial or essential for the functioning of the embodiment—unless explicitly stated to the contrary.

The invention claimed is:

1. A thick matter conveying system (10), having a thick matter pump (16) for conveying thick matter, comprising a double-piston core pump (15) having a pump frequency, and an S-pipe (24) which is switchable at the pump frequency, a thick matter distributor mast (18) for distributing the thick matter to be conveyed, wherein the thick matter distributor mast (18) has at least two mast arms (41), a substructure (30) on which are disposed the thick matter distributor mast (18) and the thick matter pump (16), wherein the substructure (30) comprises a support structure (31) for supporting the substructure (30) by way of at least one horizontally and/or vertically displaceable support leg (32), a sensor unit (11) for sequentially capturing at least one item of operational information at at least a first and a second point in time, and a processing unit (12) which determines a stability parameter of the thick matter conveying system (10) depending on the at least one item of operational information captured at the first point in time, the at least one item of operational information captured at the second point in time, and the pump frequency, wherein the processing unit (12) determines the stability parameter depending on a result of a mean value formation, wherein the mean value formation takes place depending on the captured items of operational information.

2. The thick matter conveying system (10) of claim 1, wherein the sensor unit (11) has one or a plurality of sensors for capturing the pump frequency, and the processing unit (12) determines the stability parameter of the thick matter conveying system (10) depending on the captured items of operational information and the captured pump frequency.

3. The thick matter conveying system (10) of claim 1, wherein a temporal interval between the first and the second point in time is dependent on the pump frequency.

4. The thick matter conveying system (10) of claim 3, wherein the second point in time is shifted or lags by the duration of half a pumping period compared to the first point in time.

5. The thick matter conveying system (10) of claim 1, wherein the at least one item of operational information captured at the first point in time is the most recent captured item of operational information.

6. The thick matter conveying system (10) of claim 1, wherein the processing unit (12) determines the stability parameter depending on items of operational information captured at a plurality of first and at a plurality of second points in time, wherein each of the plurality of the second points in time lags in relation to a respective corresponding point in time of the plurality of the first points in time by the duration of half a pumping period.

7. The thick matter conveying system (10) of claim 1, wherein the processing unit (12) at least temporarily stores a plurality of items of operational information which have been captured at points in time before the first point in time.

8. The thick matter conveying system (10) of claim 7, wherein the processing unit (12) stores captured items of operational information which have been captured at a point in time that lags behind the first point in time at most by the duration of one pumping period.

9. The thick matter conveying system (10) of claim 1, wherein the sensor unit (11) uses the same sensor to record the items of operational information to be sequentially captured at the first and second point in time.

10. The thick matter conveying system (10) of claim 1, wherein the sensor unit (11) sequentially records an item of operational information which is indicative of one of the following properties:

a joint torque of at least one of the mast arms (41), a cylinder force of at least one of the mast arms (41), an inclination angle of at least one mast arm (41), an actuator force of at least one actuator of a mast arm (41), an operating speed of at least one actuator of a mast arm (41), a load weight at a load attachment point of the thick matter distributor mast (18), a rotating speed of a slewing gear (19), an inclination angle of the thick matter conveying system (10), a horizontal leg force of the at least one support leg (32), and a vertical leg force of the at least one support leg (32).

11. The thick matter conveying system (10) of claim 10, wherein the processing unit (12) calculates a load torque based on captured items of operational information which are indicative of the joint torques of all mast arms (41), and determines the stability parameter depending on the calculated load torque.

12. The thick matter conveying system (10) of claim 1, wherein the processing unit (12) calculates a current position of an overall center of gravity of the thick matter conveying system (10) from a plurality of different types of captured items of operational information, and determines the stability parameter depending on the calculated current position of the overall center of gravity.

13. The thick matter conveying system (10) of claim 1, wherein the substructure (30) is disposed on a vehicle (33).

14. A thick matter conveying system (10) further comprising:

a thick matter pump (16) for conveying thick matter, comprising a double-piston core pump (15) having a pump frequency, and an S-pipe (24) which is switchable at the pump frequency, a thick matter distributor mast (18) for distributing the thick matter to be conveyed, wherein the thick matter distributor mast (18) has at least two mast arms (41), a substructure (30) on which are disposed the thick matter distributor mast (18) and the thick matter pump (16), wherein the substructure (30) comprises a support structure (31) for supporting the substructure (30) by way of at least one horizontally and/or vertically displaceable support leg (32), a sensor unit (11) for sequentially capturing at least one item of operational information at at least a first and a second point in time, a processing unit (12) which determines a stability parameter of the thick matter conveying system (10) depending on the at least one item of operational information captured at the first point in time, the at least one item of operational information captured at the second point in time, and the pump frequency, and a control unit (13) for emitting a first control signal if the determined stability parameter of the thick matter conveying system (10) is greater than a maximum stability parameter of the thick matter conveying system (10), and to emit a second control signal if the determined stability parameter of the thick matter conveying system (10) is less than or equal to the maximum stability parameter of the thick matter conveying system (10).

15. The thick matter conveying system (10) of claim 14, wherein the control unit (13) limits an operating range of the thick matter distributor mast (18) to a currently permissible operating range, if the determined stability parameter of the thick matter conveying system (10) is greater than the maximum stability parameter.

16. A method (100) for operating a thick matter conveying system (10) which comprises a thick matter pump (16) for conveying a thick matter, a thick matter distributor mast (18) for distributing the thick matter to be conveyed by way of at least two mast arms (41), a substructure (30) on which are disposed the thick matter distributor mast (18) and the thick matter pump (16), a sensor unit (11) for sequentially capturing at least one item of operational information, a processing unit (12), and a control unit (13), wherein the thick matter pump (16) comprises a double-piston core pump (15) having a pump frequency, and an S-pipe (24) which is switchable at the pump frequency, and wherein the substructure (30) comprises a support structure (31) for supporting the substructure (30) by way of at least one horizontally and/or vertically displaceable support leg (32), the method comprising the following steps:

sequentially capturing, by the sensor unit (11), at least one item of operational information at at least a first point in time (101*b*) and a second point in time (101*a*), determining (104), by the processing unit (12), a stability parameter of the thick matter conveying system (10) depending on the item of operational information captured at the first point in time, the item of operational information captured at the second point in time, and the pump frequency, emitting (105), by the control unit (13) of the thick matter conveying system (10), a first control signal if the determined stability parameter of the thick matter conveying system (10) is greater than a maximum stability parameter of the thick matter conveying system (10), and emitting (106), by the control unit (13), a second control signal if the determined stability parameter of the thick matter conveying system (10) is less than or equal to the maximum stability parameter of the thick matter conveying system (10).

17. The method (100) of claim 16, wherein emitting (107) the first control signal comprises the following step:

limiting (107) the operating range of the thick matter distributor mast (18) to a currently permissible operating range.

* * * * *